United States Patent [19]

Shepley

[11] 4,395,933

[45] Aug. 2, 1983

[54] MOUTHPIECE FOR BRASS-WIND INSTRUMENTS

[76] Inventor: Joseph J. Shepley, 26 Linn Pl., Yonkers, N.Y. 10705

[21] Appl. No.: 341,523

[22] Filed: Jan. 21, 1982

[51] Int. Cl.[3] ..... G10D 9/02

[52] U.S. Cl. ..... 84/399

[58] Field of Search ..... 84/398, 399

[56] References Cited

U.S. PATENT DOCUMENTS

| | | | |
|---|---|---|---|
| 1,691,669 | 11/1928 | Ostendorf | 84/399 |
| 2,018,738 | 10/1935 | Parduba | 84/398 |
| 2,232,608 | 2/1941 | Hulsaver | 84/398 |
| 2,594,869 | 4/1952 | Cauffman | 84/398 |

*Primary Examiner*—Lawrence R. Franklin
*Attorney, Agent, or Firm*—Kane, Dalsimer, Kane, Sullivan and Kurucz

[57] ABSTRACT

A mouthpiece for a musical instrument having a body member with a tapered tubular backbore at one end engageable to fit a musical instrument and a cup and rim at its opposite end, each of which is detachably maintained together to form the mouthpiece. The cup is provided with a plurality of annular internal sections to create a predetermined resistance to air flow through the mouthpiece thereby controlling the tone produced with a change of the axial length of the sections resulting in a change in resistance and accordingly the tone.

6 Claims, 4 Drawing Figures

MOUTHPIECE FOR BRASS-WIND INSTRUMENTS

FIELD OF THE INVENTION

The present invention is directed towards a mouthpiece for brass-wind instruments particularly for a trumpet, trumbone, etc.

BACKGROUND OF THE INVENTION

There exists today many known types of mouthpieces for brass musical instruments. These include typically the Bach, Giardinelli and Jet-tone types. Variations or modifications of the construction of mouthpieces have been attempted to improve the tone or quality or pitch of particular instruments. Examples of such modifications can be found in U.S. Pat. No. 2,018,738 issued Oct. 29, 1935; U.S. Pat. No. 2,232,608 issued Feb. 18, 1941; U.S. Pat. No. 2,376,453 issued May 22, 1945 and U.S. Pat. No. 3,370,500 issued Feb. 27, 1968. While each of the modifications by these patents may have provided improved performance in certain respects, in other respects, it is at the expense of performance in other areas.

Also, none of the existing mouthpieces allows for practical variation thereof to accommodate the needs of the individual player or type of music. Accordingly, a great many players, beginners and professionals, play with standardized mouthpieces, requiring them to vary their style i.e., air or wind. This is necessary to vary or set the resistance in the particular mouthpiece resulting in, among other things, range and endurance problems. Accordingly there is a need to provide for brass-wind players a mouthpiece which allows them to perform with the same comfort and ease as a fixed pitch instrument, i.e., piano etc., while providing a mouthpiece which is readily adaptable to meet their individual needs.

SUMMARY OF THE INVENTION

Accordingly, it is an object of the invention to provide a mouthpiece that allows for improved player performance by being readily fabricated to the requirements of individual players.

It is another object to provide for a mouthpiece which provides for improved range of a player without requiring increased air or wind at the same time providing increased endurance, ease of play and tonal quality.

It is a yet further object to provide for a mouthpiece that is capable of meeting the demands of various types of music without requiring the player to constantly change mouthpieces as the type of music changes.

These objects are realized by the present invention which provides for a mouthpiece preferably fabricated from three assembled parts including a cup, rim and backbore. The cup is formed of four wall sections of differing angularity with respect to the longitudinal axis of the mouthpiece. At the entrance or rim of the mouthpiece the angularity of the cup is approximately 60° for the first section, with each section thereafter reduced approximately 15°. The last three sections are balanced by the third section so as to handle the volume of air to provide the desired resistance to meet the individual player's requirement.

This is accomplished by varying the length of the separate sections which changes the resistance of air flow in the throat, tempering the musical scale. For example, if the length of the second section (at 30°) is increased, the resistance is reduced providing for an increased pitch. Decreasing the length results in increased resistance, flattening the pitch. Accordingly, the needs of an individual player can be achieved by the selection of the proper cup, which may readily be assembled in the mouthpiece.

When the resistance is accordingly matched to the particular player, exposing a young player to a hard to blow, out of tune situation can be avoided. An older experienced player will realize increased range, endurance, ease and tonal quality. There is no need to change mouthpieces when different type music is involved because with the matched resistance, a player can play with the same mouthpiece all types of music with consistent control.

Accordingly, the aforenoted objects and advantages and others will be realized by the present invention as will be apparent from the description herein which is to be taken in conjunction with the drawings.

BRIEF DESCRIPTION OF THE DRAWINGS

FIG. 4 is a perspective view of the mouthpiece incorporating the teachings of the present invention shown disposed on a trumpet or the like.

DETAILED DESCRIPTION OF THE PREFERRED EMBODIMENT

Figure 1:
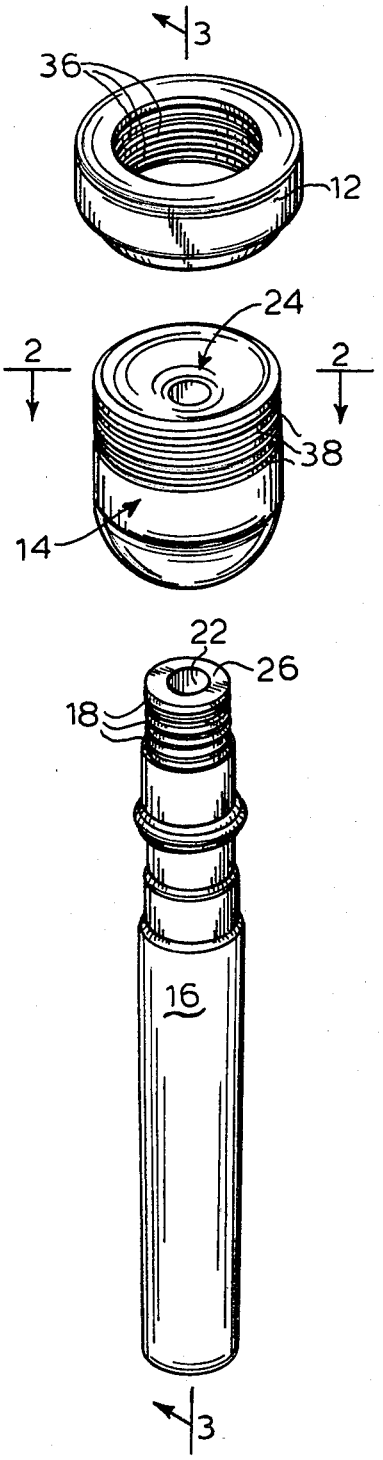
FIG. 1 is a perspective exploded view of the mouthpiece form of three pieces incorporating the teachings of the present invention.
Figure 2:
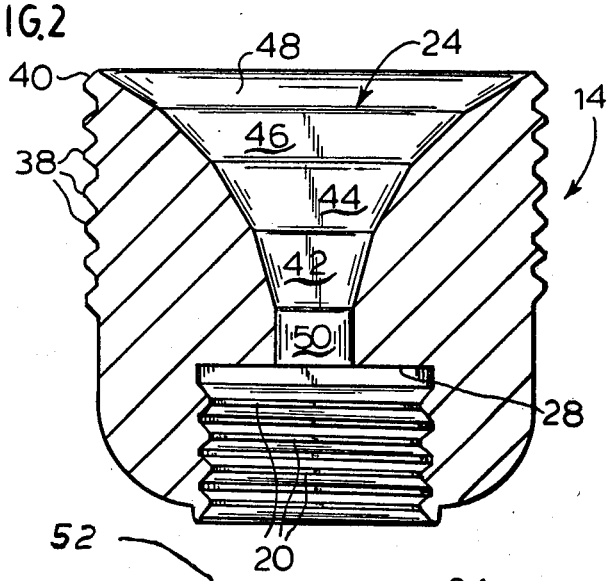
FIG. 2 is a sectional view taken along line 2—2 shown in FIG. 1, of the cup portion incorporating the teachings of the present invention.
Figure 3:
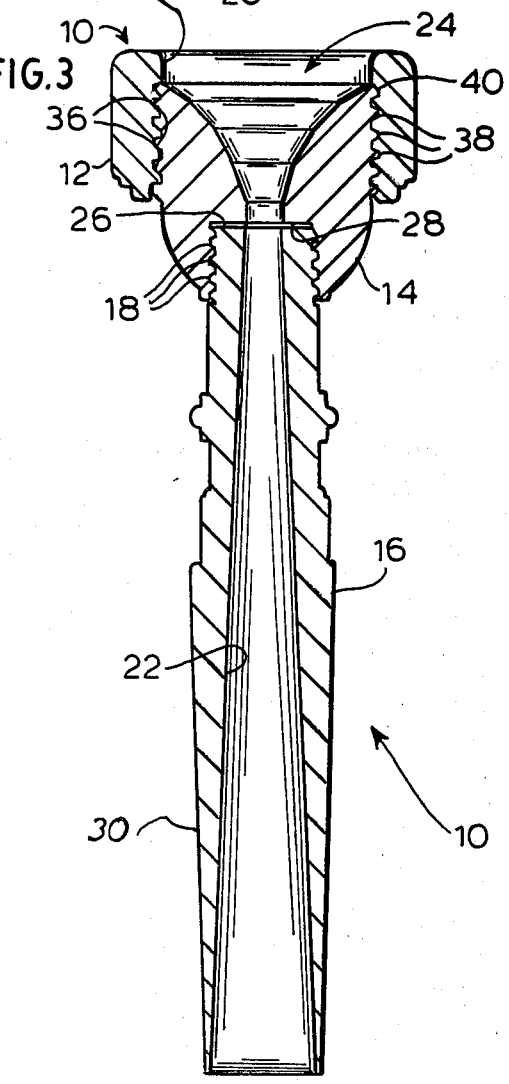
FIG. 3 is a sectional view taken along line 3—3 shown in FIG. 1 of the mouthpiece.
Figure 4:
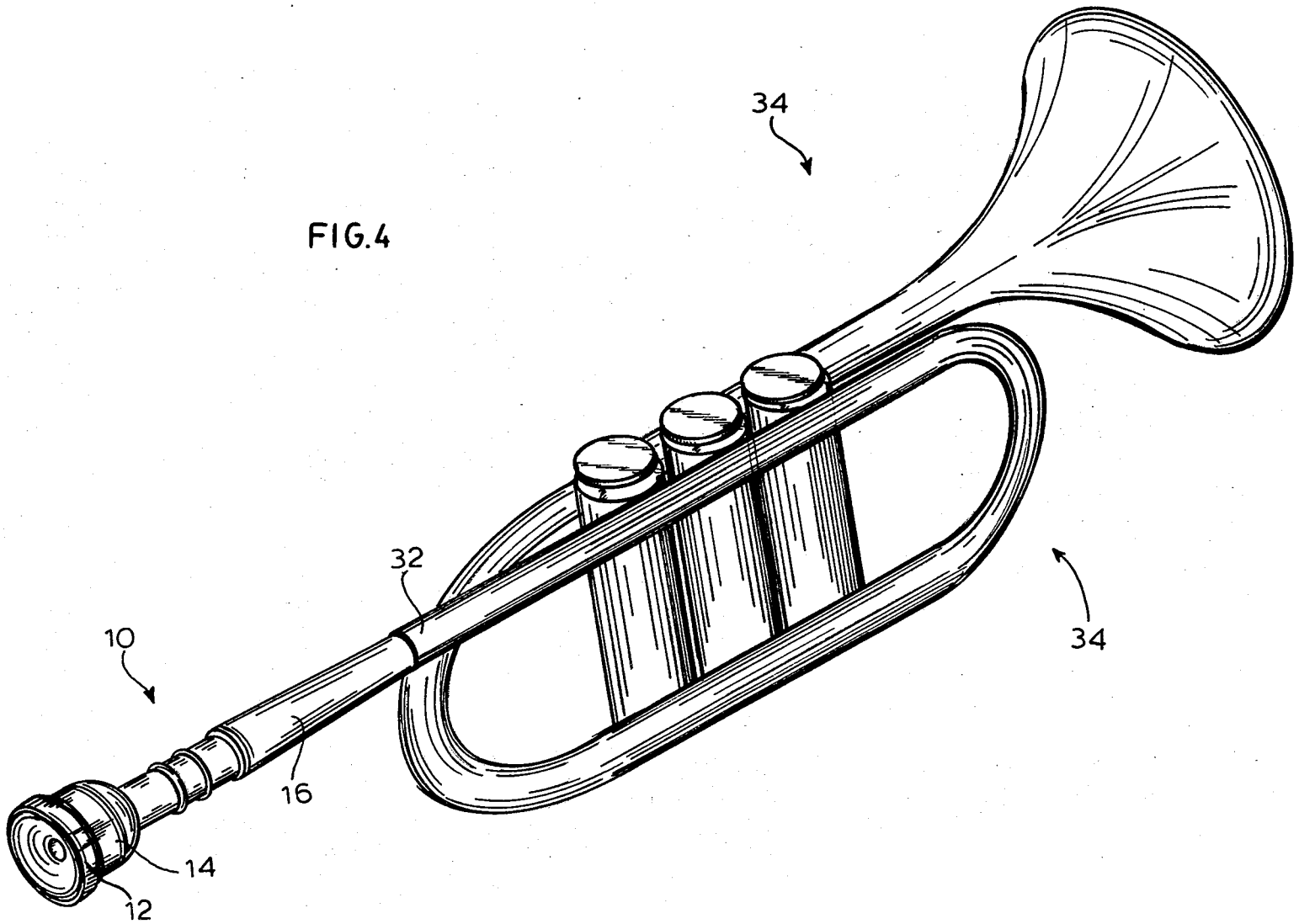

Turning now to the drawings, there is shown a mouthpiece generally designated by numeral 10, which is preferably fabricated in three separate pieces, including a rim 12, cup 14 and backbore 16. As can be seen, each of these pieces may be joined together by way of a thread arrangement to form a single mouthpiece. In this regard, the backbore 16 is provided with thread 18 at its top end which is intended to be screwed in a mating relationship with an internal thread 20 formed in the cup 14. As can be seen in FIG. 3, the backbore 16 is provided with an internal outwardly tapering bore 22 which axially mates with the internal surface 24 of cup 14. The annular surface 26 about bore 22 flushly engages annular surface 28 of the cup 14. The lower external surface 30 of the backbore 16 is intended to be axially placed in a friction fit with the mouth 32 of a trumpet 34 or other similar instruments, as shown in FIG. 4.

The rim 12 is provided with an internal thread 36 intended to mate with an external thread 38 provided on the upper portion of the cup 14. Upper surface 40 of the cup 14 is in an abutting relation with an internal annular surface 40 of rim 12 when these two pieces are threaded together. Note that threading on of the pieces together may take place in the same direction to readily provide a secure mating thereof.

Turning now to the cup 14, the internal surface 24 is provided with a plurality of smoothly finished tapering annular sections 42–48. It has been found that approximately 15° change in taper provides the most efficient change which as hereinafter discussed allows for directing air more efficiently through the mouthpiece. In this regard, the first section 42 is provided with approximately a 15° taper change from the longitudinal axis through cup 14. This can be seen by the angle of inclination in section 42 as compared to the straight wall portion 50 adjacent thereto. Section 44 is then tapered 15° more than section 42, with 46 tapered 15° more than section 44 and section 48 tapered 15° more than section 46. The angles involved would therefore be 15°, 30°, 45° and 60° from the longitudinal axis.

In the playing of the instrument, some resistance to a flow of air through the mouthpiece 10 is desired to provide a desirable tone. Sections 42 through 46 are balanced to handle the volume of air so that too much resistance is not experienced. Particularly section 44 balances out sections 42 and 46.

The axial lengths of the sections can be separately varied to change the resistance and accordingly the pitch. For example, if the axial length of section 46 was increased, this would reduce the resistance and increase the pitch. Conversely, if the axial length of section 42 is increased then the resistance would be increased, deepening the sound. Note that the axial length of section 44 usually remains constant.

A change also in length of straight portion 50 will also change the pitch. For example, if it is shortened, it will cause a "darkening" of the sound, less brilliance.

Regarding section 48, this essentially determines the volume of air involved, it has been found that if the angle is over 60° (120° from side to side) the sound produced is more of a shrill; if it is under 60° (120° from side to side) the sound gets deeper. Note that here as in the case of the other sections, if the angle of tapering is changed, the sound and scale are likewise changed. In this regard it should be understood that the distance of the lips to the straight portion 50 is important. If it is too short the quality of the sound is not acceptable. Too far and you increase the work involved for a note. In this regard, the depth of the cup 14 does not change, rather the axial lengths of sections 42–48 do to provide for the particular players resistance needs. Previously a player had to adjust his air or wind to set the resistance of the mouthpieces heretofore utilized which resulted in range and endurance problems. By adjusting the resistance as aforenoted, it is possible for the player to perform with the same comfort and ease as fixed pitch instruments. It allows young players to avoid hard to blow mouthpieces with experienced players having added range, endurance, ease of play, tonal quality and a consistent musical scale throughout the range of their instrument.

Note that the rim 12, removably maintained on the cup, has an annular opening 52 the depth of which can change depending upon the particular players features to allow desired distance from lips to the straight portion 50.

Because the cup 14, backbore 16 and rim 12 are all detachable, modifications can be readily made to adjust the cup 14 to set the desired resistance for the particular player, advantageously allowing a somewhat standardization of the rim 12 and backbore 16 and practical versatility of the mouthpiece.

Thus the aforenoted objects and advantages are realized and while a preferred embodiment has been disclosed and described herein, its scope should not be limited thereby, rather its scope should be determined by that of the appended claims.

What is claimed is:

1. A mouthpiece for a musical instrument, said mouthpiece comprising:

a body member having a tapered tubular backbore at one end engageable to fit a musical instrument and a cup and rim at its opposite end;

said cup including a plurality of annular internal sections providing a predetermined resistance to air flow through the mouthpiece controlling the tone produced thereby with a change of the axial length of said sections resulting in a change in said resistance and accordingly said tone, each section being disposed at an angle of approximately 15° difference with respect to the angularity of sections adjacent thereto.

2. The invention in accordance with claim 1 wherein said cup includes at least three adjacent sections disposed at predetermined angularity with respect to the mouthpiece's longitudinal axis, a second section disposed between a first and third section balancing the effect the first and third sections have on the tone.

3. The invention in accordance with claim 2 which includes a fourth section adjacent said rim and said third section of an angle and axial length of which determines the amount of air entering the mouthpiece.

4. The invention in accordance with claim 3 wherein said fourth section is disposed at an angle of approximately 60° with respect to the mouthpiece's longitudinal axis.

5. The invention in accordance with claims 1, 2, 3 or 4 wherein said rim, cup and backbore are each separate parts of the mouthpiece, detachably maintained together by screw-thread portions between the rim and cup; cup and backbore.

6. A mouthpiece for a musical instrument, said mouthpiece comprising:

a body member having a longitudinal axis and a tapered tubular backbone at one end engageable to fit a musical instrument and a cup and rim at its opposite end;

said cup including at least three annular internal sections providing a predetermined resistance to air flow through the mouthpiece controlling the tone produced thereby with a change of the axial length of said sections resulting in a change in said resistance and accordingly said tone, the annular internal sections each being circular and progressively increasing in angularity relative to the longitudinal axis from the backbore to the rim.

* * * * *